US005928731A

United States Patent [19]

Yanagida et al.

[11] Patent Number: 5,928,731

[45] Date of Patent: Jul. 27, 1999

[54] ELECTROSTATIC POWDER SPRAY COATING METHOD

[75] Inventors: Kenzo Yanagida; Mituyosi Kumata; Masahiro Yamamoto, all of Tokyo; Shannon Libke; Takao Amasaki, both of Osaka; Koichi Tsutsui, Kyoto, all of Japan

[73] Assignees: Nihon Parkerizing Co., Ltd., Tokyo; Nippon Paint Co., Ltd., Osaka-fu, both of Japan

[21] Appl. No.: 08/867,826

[22] Filed: Jun. 3, 1997

[51] Int. Cl.[6] ..... B05D 1/04

[52] U.S. Cl. ..... 427/475; 427/477; 427/485; 427/486

[58] Field of Search ..... 427/475, 477, 427/485, 486; 118/620, 621, 627, 629; 239/3, 112, 690

[56] References Cited

U.S. PATENT DOCUMENTS 3,608,823 9/1971 Buscher .
3,996,410 12/1976 Gruetzman .
4,170,074 10/1979 Heckman et al. .
4,774,102 9/1988 Kiefer et al. .
5,582,347 12/1996 Knobbe et al. ..... 239/3

*Primary Examiner*—Shrive Beck
*Assistant Examiner*—Fred J. Parker
*Attorney, Agent, or Firm*—Wenderoth, Lind & Ponack, L.L.P.

[57] ABSTRACT

A high voltage generated by a high voltage generator is applied to corona electrodes, and powder supplied from a powder flow passage collides against a diffuser main body while being moved in a vortex by air ejected from a vortex air introduction port and is ejected from a nozzle opening. After the powder is charged by ions generated by corona discharge, it is sprayed to an object to be coated. Free ions generated by the corona discharge are trapped by ion trap electrodes. The adhesion of the powder can be prevented by the ejection of compressed air through a diffuser front portion cover and an outer cylinder cover each composed of a porous member and the ejection of compressed air from a nozzle hole.

3 Claims, 4 Drawing Sheets

ELECTROSTATIC POWDER SPRAY COATING METHOD

BACKGROUND OF THE INVENTION

1. Field of the Invention

The present invention relates to an electrostatic powder spray gun and a coating method used for decorative coating such as automotive clear top coating and the like.

2. Description of the Related Art

Attention has been paid to electrostatic powder coating as a nonpolluting coating method using no solvent from the ecological point of view. In electrostatic powder coating, a powder coating is supplied from a powder hopper to a spray gun through an injector and sprayed toward an object to be coated from a nozzle opening formed at an extreme end of the spray gun together with a conveying air flow. At this time, a high voltage is applied to a pin type electrode disposed at the extreme end of the spray gun as the object to be coated is electrically grounded and corona discharge is generated from the electrode of the spray gun toward the object to be coated. As a result, when the powder coatings sprayed from the nozzle opening pass by the vicinity of the electrode, the powder coatings are charged by the collision thereof with the ions generated by the corona discharge. The thus charged powder particles are coated on the surface of the object to be coated by being affected by the conveying air flow and electric lines of force.

Although powder coatings having an average particle size of 30–40 $\mu$m usually have been used in electrostatic powder coating, since an obtained coating film has smoothness inferior to that of solvent coating, it has been attempted to obtain a decorative coating film excellent in smoothness using fine particle coatings having an average particle size of 25 $\mu$m or less.

However, when the particle size of powder is reduced, the powder is condensed or is liable to be adhered to a powder hose, a spray gun and the like by being strongly affected by electrostatic force. As a result, since it is difficult to stably supply fine particle powder coatings to the spray gun, it is difficult to form a coating film having desired smoothness.

Further, since many of the ions generated by corona discharge adhere to the surface of an object to be coated as free ions, as powder particles deposit on the object to be coated, the free ions also accumulate on the surface of the object to be coated. Thus, there also arises a problem that the electrostatic potential on the surface of the object to be coated gradually increases to thereby lower the transfer efficiency of the powder particles. Further, when the field intensity in a powder particle layer increases as described above and exceeds the dielectric breakdown field intensity level of air, minute discharge takes place in the powder particle layer, that is, a so-called reverse ionization phenomenon is caused with a consequent rough surface of a coating film.

SUMMARY OF THE INVENTION

An object of the present invention is to solve the above problem and to provide an electrostatic powder spray gun capable of forming a coating film excellent in smoothness at a high transfer efficiency using fine particle powder coatings.

Another object of the present invention is to provide an electrostatic powder coating method capable of stably forming a coating film excellent in smoothness using fine particle powder coatings.

An electrostatic powder spray gun according to the present invention for electrostatically coating charged powder coatings on the surface of an object to be coated and grounded electrically comprises a gun main body; an inner cylinder disposed at an extreme end of the gun main body and having a powder flow passage formed thereat; diffuser disposed to a front end of the inner cylinder and forming an annular nozzle opening by dispersing the powder flow passage along a conical surface; a plurality of corona electrodes disposed on a circle concentric with the nozzle opening at equal intervals inwardly of the nozzle opening; an outer cylinder cover covering the inner cylinder so as to form an outer cylinder cover cleaning air chamber between such cover and the outer peripheral portion of the inner cylinder and composed of a porous material for ejecting compressed air supplied into the outer cylinder cover cleaning air chamber to the outside; a plurality of ion trap electrodes disposed at an outer peripheral portion of the outer cylinder cover and grounded electrically for collecting free ions generated by corona discharge; and a high voltage generator disposed in the gun main body for imposing a high voltage on the plurality of corona electrodes.

The diffuser may be composed of a diffuser main body through which a compressed air passage is formed and a diffuser front cover having a diffuser cleaning air chamber formed in the front end portion of the diffuser main body and inwardly of the nozzle opening and composed of a porous material for ejecting forwardly compressed air supplied into the diffuser cleaning air chamber.

The spray gun may include a plurality of ion trap support members for supporting corresponding ion trap electrodes and having compressed air passages formed therethrough and ion trap extreme end covers attached to the respective ion trap support members for forming ion trap cleaning air chambers to the roots of the ion trap electrodes and having nozzle holes formed thereat for ejecting compressed air supplied into the ion trap cleaning air chambers to the extreme ends of the ion trap electrodes.

Vortical stream forming means for forming a vortical stream in the powder flow passage may be included in the inner cylinder.

An electrostatic powder coating method according to the present invention for electrostatically coating charged powder particles on the surface of an object to be coated and grounded electrically comprises generating corona discharge by imposing a high voltage on a plurality of corona electrodes disposed on a circle concentric with an annular nozzle opening of a spray gun at equal intervals inwardly of the nozzle opening; spraying fine particle powder having an average particle size of 25 $\mu$m or less to an object to be coated from the annular nozzle opening through a powder flow passage disposed along a conical surface; removing the fine particle adhered to an outside surface of an outer cylinder cover covering an outer peripheral portion of the spray gun and composed of a porous material by ejecting compressed air to the outside from the inside of the outer cylinder cover therethrough; and trapping free ions generated by the corona discharge by a plurality of ion trap electrodes disposed at an outer peripheral portion of the outer cylindrical cover and grounded electrically.

It is effective to use fine particle powder having a spherical shape.

The fine particle powder may be supplied to the spray gun using a powder feed device in which the interior of a paint vessel is partitioned into an upper fluidized-bed hopper and a lower air chamber by a porous fluidizing board and compressed air whose temperature and humidity are regulated is flown from the air chamber into the fluidizing tank through the porous material while stirring the powder in the fluidized-bed hopper for fluidizing the powder, whereby a desired coating film can be formed on an automotive body to which an undercoating layer has been formed.

DESCRIPTION OF THE PREFERRED EMBODIMENT

An embodiment of the present invention will be described with reference to the accompanying drawings.

Figure 1:
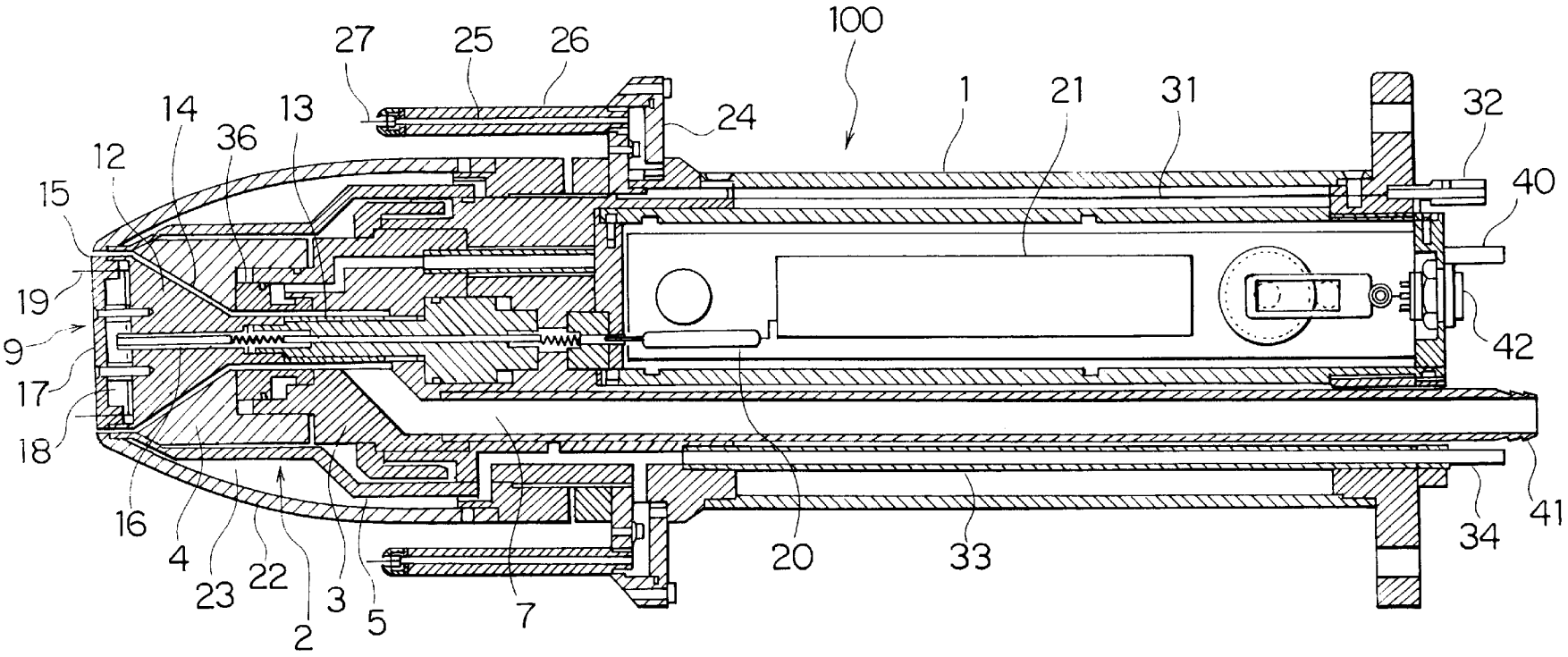
FIG. 1 is a cross sectional view showing the arrangement of a spray gun according to an embodiment of the present invention.

FIG. 1 shows the arrangement of an electrostatic powder spray gun 100 according to an embodiment of the present invention. The spray gun 100 includes a cylindrical gun main body 1 and an inner cylinder 2 is disposed at an extreme end of the gun main body 1. As definitely shown in the enlarged view of FIG. 2, the inner cylinder 2 is composed of an inner cylinder member 3 coupled with the extreme end of the gun main body 1, an inner cylinder member 4 coupled with the extreme end of the inner cylinder member 3 and an inner cylinder cover member 5 covering outer peripheral portions of inner cylinder members 3 and 4. The inner cylinder member 3 has a pipe-shaped opening 6 formed on the center axis thereof and a powder flow passage 7 is formed to communicate with the opening 6. On the other hand, the inner cylinder member 4 has a conical opening 8 which communicates with the opening 6 of the inner cylinder member 3 and which has a diameter increasing in a forward direction.

A diffuser 9 is inserted into the openings 6 and 8 of the inner cylinder members 3 and 4. The diffuser 9 has a diffuser main body 12 which is composed of a column portion 10 and a conical portion 11 which is coupled with the column portion 10 and has a diameter increasing in a direction away from the column portion 10. The column portion 10 of the diffuser main body 12 has a diameter slightly smaller than that of the opening 6 of the inner cylinder member 3 and a cylindrical flow passage 13 communicating with the powder flow passage 7 is formed between the outer peripheral surface of the column portion 10 and the opening 6 of the inner cylinder member 3. On the other hand, the conical portion 11 of the diffuser main body 12 is slightly smaller than the conical opening 8 of the inner cylinder member 4, a conical flow passage 14 communicating with the flow passage 13 is formed between the outer peripheral surface of the conical portion 11 and the opening 8 of the inner cylinder member 4 and an annular nozzle opening 15 communicating with the flow passage 14 is formed between the outer peripheral surface of the conical portion 11 and the extreme end portion of the inner cylinder cover member 5. Further, the diffuser main body 12 has a compressed air passage 16 formed on the axis thereof and opened to the front end surface of the conical portion 11.

The diffuser 9 further has a diffuser front cover 17 which is composed of a porous material and attached to the front end of the diffuser main body 12. The diffuser front cover 17 permits a diffuser cleaning air chamber 18 which communicates with the compressed air passage 16 to be formed between cover 17 and the front end surface of the diffuser main body 12 internally of the nozzle opening 15.

Figure 3:
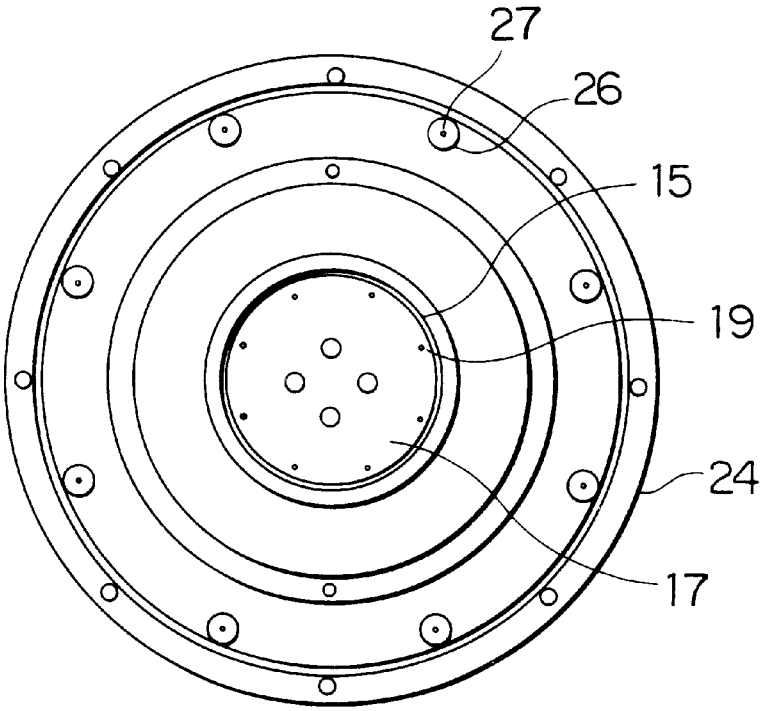
FIG. 3 is a front elevational view showing the spray gun of FIG. 1.

Pin-shaped corona electrodes 19 are disposed at the front end of the diffuser main body 12 internally of the nozzle opening 15 and the extreme ends of the corona electrodes 19 pass through the diffuser front cover 17 and project forward of the diffuser 9. As shown in FIG. 3, eight corona electrodes 19 are disposed on a circle concentric with the nozzle opening 15 at equal intervals. The respective corona electrodes 19 are electrically connected to each other, pass through the compressed air passage 16 of the diffuser main body 12 and are connected to a high voltage generator 21 through a protection resistance 20 in the gun main body 1.

An outer cylinder cover 22 composed of a porous material is disposed at the outer peripheral portion of the inner cylinder 2 and an outer cylinder cover cleaning air chamber 23 is formed between the outer peripheral surface of the inner cylinder cover member 5 and the outer cylinder cover 22.

A ring member 24 is disposed at the outer periphery of the extreme end portion of the gun main body 1 and rod-shaped ion trap support members 26 are attached to the ring member 24, each ion trap support member 26 projecting forward by the gun and having a compressed air passage 25 formed on the center axis thereof. Pin-shaped ion trap electrodes 27 are fixed to the extreme ends of the respective ion trap support members 26. Further, each of the ion trap support members 26 has an ion trap extreme end cover 29 formed at the extreme end thereof. The ion trap extreme end cover 29 forms an ion trap cleaning air chamber 28 communicating with the compressed air passage 25 at the root of the ion trap electrode 27 and has a nozzle hole 28*a* formed therethrough which ejects compressed air in the air chamber 28 toward the extreme end of the ion trap electrode. As shown in FIG. 3, eight ion trap support members 26 and the ion trap electrodes 27 are disposed at equal intervals on circles concentric with the nozzle opening 15. The respective ion trap electrodes 27 are electrically connected to each other by a ring-shaped electric conductor member 30 and electrically connected to a ground terminal 32 disposed at the rear of the gun main body 1 through a lead wire 31 in the gun main body 1 as shown in FIG. 1.

A compressed air supply pipe 33 is disposed in the gun main body 1. The compressed air passage 16 of the diffuser main body 12, the outer cylinder cover cleaning air chamber 23 and the compressed air passages 25 of the ion trap support members 26 communicate with the front end of the compressed air supply pipe 33. The rear end of the compressed air supply pipe 33 is connected to a compressed air supply port 34 disposed at the rear of the gun main body 1.

Figure 2:
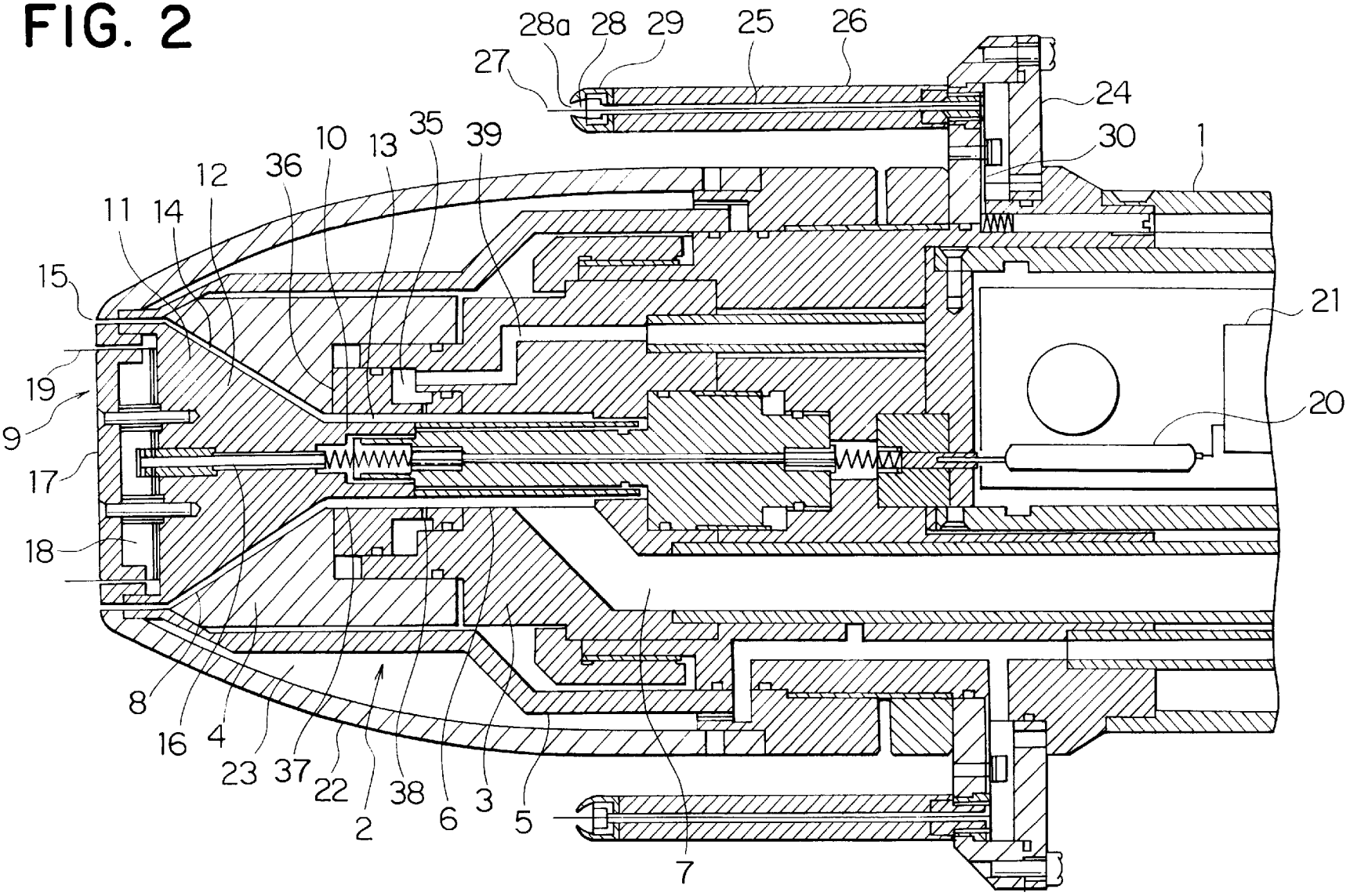
FIG. 2 is an enlarged view of the main portion of FIG. 1.
Figure 4:
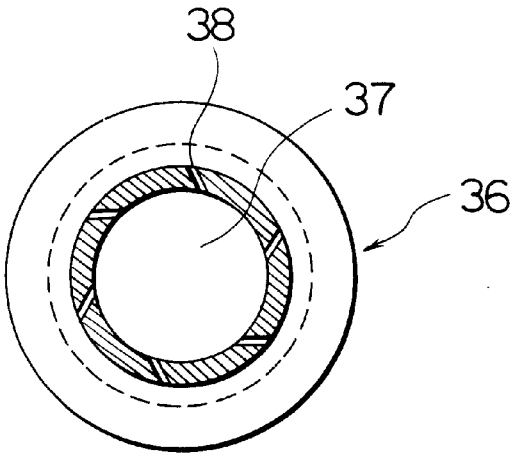
FIG. 4 is a cross sectional view showing a vortical stream forming member of the spray gun of FIG. 1.

As shown in FIG. 2, a ring-shaped vortical stream forming member 36 is formed at the extreme end of the inner cylinder member 3 of the inner cylinder 2 to form an annular vortex air chamber 35 between member 36 and the inner cylinder member 3. As shown in FIG. 4, an opening 37 which is continuously connected to the opening 6 of the inner cylinder member 3 is formed at the center of the vortical stream forming member 36 and a plurality of vortex air introduction ports 38 are formed around the opening 37 in directions tangential to the opening 37. The vortex air chamber 35 communicates with the flow passage 13 through vortex air introduction ports 38. The vortex air chamber 35 communicates with a vortex air passage 39 formed in the inner cylinder member 3 and further connects to a vortex air supply port 40 disposed at the rear of the gun main body 1 through a not shown vortex air supply pipe disposed in the gun main body 1.

A powder supply port 41 communicating with the powder flow passage 7 is further disposed at the rear of the gun main body 1 and a power supply terminal 42 is also disposed thereat to supply electric power to the high voltage generator 21.

The diffuser front cover 17 and the outer cylinder cover 22 are composed of a porous material such as calcined polyethylene, teflon or other types of porous resin. The inner cylinder members 3 and 4, the inner cylinder cover member 5, the diffuser main body 12, the ion trap support members 26, the vortical stream forming member 36 and the like other than the above are composed of a resin such as teflon, high density polyethylene or the like so that the powder is unlikely to adhere thereto.

Figure 5:
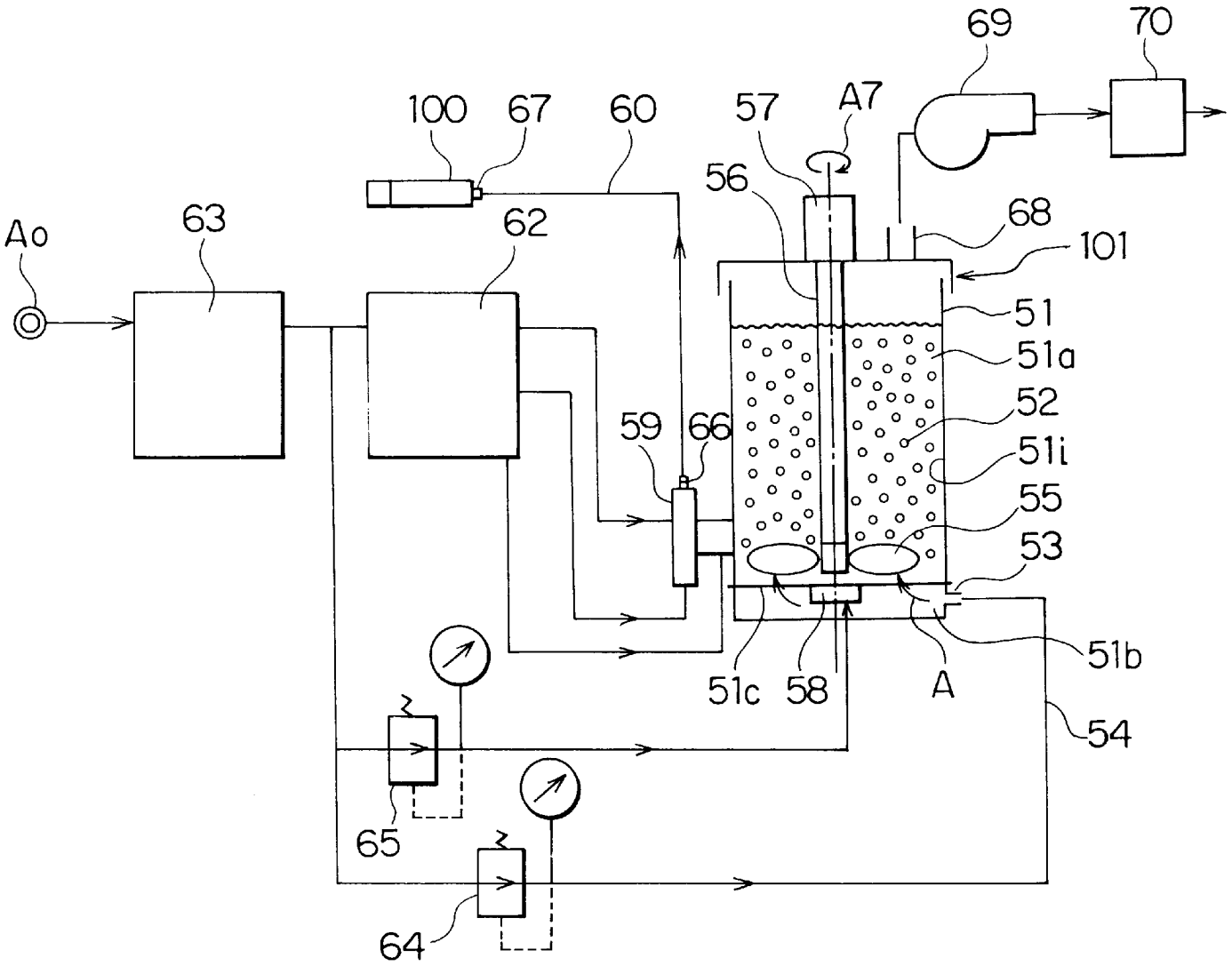
FIG. 5 is a block diagram showing the arrangement of a powder feed system used in an electrostatic powder coating method of the present invention.

FIG. 5 shows a powder feed system 101 for supplying powder paint to the spray gun 100 arranged as described above. The powder feed device 101 is mainly composed of a powder hopper 51 in which fine particle paint 52 having an average particle size of 25 μm or less and preferably 5–20 μm is accommodated, an injector 59 for pumping the fine particle powder 52, which is fluidized by fluidizing means to be described below in detail, from the powder hopper 51 and supplying under pressure the powder 52 to the spray gun 100 through a powder supply tube 60, a coating equipment control panel 62 for controlling an amount of pumped powder by regulating an amount of air to be supplied to the injector 59, a temperature/humidity controller 63 for controlling the temperature and humidity of compressed air used at the coating machine control panel 62 and the fluidizing means, an exhaust fan 69 for exhausting excessive air from exhaust port 68 of the powder hopper 51 and a filter 70 for filtering the exhaust air.

After the temperature and humidity of compressed air A supplied from a compressed air source Ao are controlled by the temperature/humidity controller 63 to a relatively low temperature of 25° C. or less and a relatively low humidity of 50% or less, the compressed air A is supplied to the coating equipment control panel 62 as fluidizing air and air vibrator driving air.

The powder hopper 51 is partitioned into a fluidized-bed 51*a* and an air chamber 51*b* by a porous board or a canvas sheet 51*c* and a fluidizing air supply pipe 54 is connected to a fluidizing air supply port 53 disposed at a side of the air chamber 51*b*. The amount of flow of the fluidizing air whose temperature and humidity are controlled to relatively low levels by the temperature/humidity controller 63 can be regulated by a pressure-reducing valve 64.

A stirring blade 55 mounted on a stirring blade supporting rod 56 is disposed in the fluidized-bed 51*a* of the powder hopper 51. The stirring blade 55 and the stirring blade supporting rod 56 function to stir the powder particles 52 in the paint vessel 51 by being rotated by a stirrer drive motor 57 in the direction of an arrow A7 at a low speed.

Vibrating means, such as aft air vibrator 58 is mounted under the canvas sheet 51*c*. The vibrating force of the air vibrator 58 is controlled by regulating the amount of flow of air by a pressure-reducing valve 65. The vibrating means is not limited to the air vibrator but may be, for example, an electric vibrator.

Powder adhesion preventing means such as, for example, a fluorine resin layer is formed at the portions of the equipment in contact with powder such as the inner surface 51*i* of the powder hopper 51, the stirring blade 55, the stirring blade supporting rod 56, the inner surface of the injector 59, the inner surface of couplings 66, 67, the inner surface of the paint supply tube 60 and the like, that is, or powder contact surfaces.

The powder adhesion preventing means is not limited to surfaces of fluorine resin but also may be a composite plated film in which fine particles of a fluorine resin are uniformly dispersed and subjected to eutectoid or an electric conductive resin layer of $10^{10}$ Ω cm or less.

Next, an electrostatic powder coating method using the electrostatic powder spray gun described above will be described. First, when a high voltage is generated by the high voltage generator 21 by connecting the power supply terminal 42 to a power supply and imposed on the corona electrodes 19, corona discharge is generated from the corona electrodes 19 toward a not shown object to be coated. Since the ion trap electrodes 27 at ground are disposed behind the corona electrodes 19, lines of electric force concentrate on the ion trap electrodes 27 and many free ions generated in the vicinity of the corona electrodes 19 move along the lines of electric force and are trapped by the ion trap electrodes 27.

On the other hand, after the temperature and humidity of the compressed air A supplied from the compressed air source Ao are regulated by the temperature/humidity controller 63 of the powder feed device 101 to a low temperature and humidity of, for example, 5–25° C. and 50% or less, the compressed air is supplied under pressure into the air chamber 51*b* from the fluidizing air supply port 53 through the fluidizing air supply pipe 54 while the amount of flow thereof is controlled by the pressure-reducing valve 64. The compressed air A in the air chamber 51*b* passes through the canvas sheet 51*c* and flows into the fluidized-bed hopper 51*a* and further flows toward the exhaust port 68 while fluidizing the fine particle powder 52 and then is exhausted to the outside of the device through the exhaust fan 69 and the filter 70.

The compressed air A from the compressed air source Ao is also supplied to the air vibrator 58 through the pressure-reducing valve 65. The air vibrator 58 vibrates the canvas sheet 51*c* to thereby vibrate the fine particle powder 52 in the fluidized-bed hopper 51*a*. Although the number of vibrations of the air vibrator 58 is suitably selected as necessary, 2000–30000 rpm, for example may be selected. When the motor 57 is driven and the stirring blade 55 in the fluidized-bed hopper 51*a* is rotated in the direction of the arrow A7, the fine particle powder 52 is turned and uniformly mixed with air. Although the rotational speed of the stirring blade 55 is selected as necessary, 10–100 rpm, for example, may be selected.

The fine particle powder 52 sufficiently fluidized as described above is supplied to the spray gun 100 from the powder paint supply port 41 shown in FIG. 1 through the injector 59, the coupling 66, the paint supply tube 60 and the coupling 67. Further, compressed air is supplied to the vortex air supply port 40 of the spray gun 100.

In FIG. 2, when the fine particle powder reaches the cylindrical flow passage 13 through the powder flow passage 7, since the air supplied from the vortex air passage 39 to the vortex air chamber 35 is ejected in the flow passage 13 in tangential directions through the vortex air introduction ports 38, the carrier air in the flow passage 13 is formed as a vortical stream about the center axis of the flow passage 13 and the powder particles collide against the conical portion 11 of the diffuser main body 12 while moving in a vortex.

With this operation, the condensed fine particle paint is loosened and dispersed and sprayed from the annular nozzle opening 15 through the flow passage 14. After the fine particle paint is charged by ions generated by the corona discharge, it is sprayed onto the object to be coated such as an automotive body and the like to which an undercoating layer has been formed, whereby a uniform coating film is obtained.

When coating is carried out using the fine particle powder 52 as described above, a portion of the fine particle powder 52 ejected from the nozzle opening 15 is liable to adhere to the vicinities of the diffuser front cover 17, the outer cylinder cover 22 and the ion trap electrodes 27. To cope with this problem, when compressed air is supplied from the compressed air supply port 34 at the rear of the gun main body 1 through the compressed air supply pipe 33, the compressed air partially enters the diffuser cleaning air chamber 18 through the compressed air passage 16 of the diffuser main body 12 and is ejected forward by the diffuser front cover 17 by passing therethrough. A portion of the compressed air is supplied into the outer cylinder cover cleaning air chamber 23 and ejected to the outside by passing through the outer cylinder cover 22 composed of the porous material. Further, a portion of the compressed air enters the ion trap cleaning air chambers 28 passing through the compressed air passages 25 of the respective ion trap support members 26 and is ejected toward the extreme ends of the ion trap electrodes 27 from the nozzle holes 28*a*. The fine particle powder 52 is blown off by the ejection of the above compressed air, so that adherence of the fine particle paint 52 to the diffuser front cover 17, the outer cylinder cover 22 and the ion trap electrodes 27 is prevented.

The roots of the ion trap electrodes 27 may be covered with ion trap extreme end covers composed of the porous material and air may be ejected through the ion trap extreme end covers without ejecting cleaning air from the nozzle holes 28*a* disposed at the ion trap extreme end covers 29.

Although the fine particle paint having the average particle size of 25 $\mu$m or less used in the above embodiment can be made by grinding powder having a larger particle size, the particles of the fine particle paint made by such mechanical grinding method have a very irregular shape.

There are known methods of manufacturing a spherical fine powder paint and include chemical manufacturing methods such as, for example, a suspension polymerization method, a seed polymerization method, an emulsion polymerization method, a dispersion polymerization method and the like, and physical manufacturing methods such as, for example, a method of forming particles to a spherical shape by thermally melting them instantly, a method of forming a coating solution to a spherical shape by spray drying, a method of forming particles to a spherical shape by shock by circulation by hot air, a method of melting and spraying a thermoplastic mixture and the like. The spherical fine particles mentioned above are not limited to particles having a perfectly spherical shape but particles having a shape near to a spherical shape are also included.

When the spherical fine particle powder obtained by the above manufacturing methods is employed in the electrostatic powder coating method of the present invention, since it is more difficult for the paint to adhere to the spray gun 100, the powder supply tube 60 and the like, spitting is reduced and the fluidity of the paint is more enhanced, whereby the powder can be more stably supplied.

In the electrostatic powder spray gun of the present invention, a coating film excellent in smoothness can be obtained by loosening and dispersing condensed fine particle paint regardless of the fact that such fine particle powder paint is used. Further, since a larger amount of free ions are trapped by the ion trap electrodes, the amount of the free ions moving toward an object to be coated is reduced, by which the occurrence of inverse ionization phenomenon caused by the free ions is prevented and powder coating excellent in transfer efficiency can be carried out. Further, the adhesion of the powder to the outer cylinder cover, the diffuser front cover and ion trap electrodes can be prevented by the ejection of the compressed cleaning air.

Further, according to the electrostatic powder coating method of the present invention, a coating film excellent in smoothness can be stably obtained by loosening and dispersing condensed fine powder regardless of the fact that fine particle powder having an average particle size of 25 $\mu$m or less is used.

What is claimed is:

1. A method of forming a powder coating on a surface of an object to be coated that has formed thereon an undercoating layer, said method comprising:

electrically grounding said surface;

generating a corona discharge by applying a voltage to a plurality of corona electrodes that are disposed inwardly of an annular nozzle opening of a spray gun and at equal intervals along a circle concentric with said annular nozzle opening;

passing fine particle powder having an average particle size of 25 $\mu$m or less through a powder flow passage passing through said spray gun and dispersed along a conical surface, while moving said powder in a vortex about a center axis of said powder flow passage, passing the thus moving powder from said powder flow passage to said annular nozzle opening, and ejecting said powder from said annular nozzle opening toward said surface to be coated;

trapping free ions generated by said corona discharge by a plurality of ion trap electrodes that are electrically grounded and that are disposed on an outer cylindrical cover formed of a porous material and covering an outer peripheral portion of said spray gun;

removing ejected powder adhering to said ion trap electrodes by ejecting compressed air to said ion trap electrodes; and removing ejected powder adhering to an outer surface of said outer cylindrical cover by ejecting compressed air through said porous material thereof from inwardly thereof to outwardly thereof.

2. A method as claimed in claim 1, wherein particles of said powder are spherical in shape.

3. A method as claimed in claim 1, further comprising supplying said powder to said spray gun from a powder supply device including a powder hopper having an interior partitioned by a porous member into an upper fluidized-bed chamber having therein powder and a lower air chamber, supplying compressed air from said air chamber through said porous member into said fluidized-bed chamber to fluidize said powder to form a fluidized-bed, regulating temperature and humidity of said compressed air before said supplying, and stirring said powder in said fluidized-bed chamber.

* * * * *